US006546918B2

(12) United States Patent
Onishi et al.

(10) Patent No.: US 6,546,918 B2
(45) Date of Patent: Apr. 15, 2003

(54) VARIABLE DELIVERY TYPE FUEL SUPPLY APPARATUS

(75) Inventors: Yoshihiko Onishi, Tokyo (JP); Kouichi Ojima, Tokyo (JP); Hiromichi Tsugami, Tokyo (JP); Shigeki Uno, Tokyo (JP); Hiroaki Ikeda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/922,724

(22) Filed: Aug. 7, 2001

(65) Prior Publication Data

US 2002/0078928 A1 Jun. 27, 2002

(30) Foreign Application Priority Data

Dec. 27, 2000 (JP) ..... 2000-398183

(51) Int. Cl.[7] ..... F02M 37/04
(52) U.S. Cl. ..... 123/506; 123/456
(58) Field of Search ..... 123/458, 456, 123/506, 446, 494

(56) References Cited

U.S. PATENT DOCUMENTS 4,777,921 A * 10/1988 Miyaki et al. ..... 123/456
4,856,482 A * 8/1989 Linder et al. ..... 123/506
5,603,303 A * 2/1997 Okajima et al. ..... 123/508
5,825,216 A * 10/1998 Archer et al. ..... 327/110
5,957,674 A * 9/1999 Zenmei et al. ..... 417/505
6,102,010 A * 8/2000 Isozumi et al. ..... 123/506

FOREIGN PATENT DOCUMENTS

JP 11-200990 7/1999 ..... F02M/59/36
JP 2000-8997 1/2000 ..... F02M/59/36

* cited by examiner

*Primary Examiner*—Carl S. Miller
(74) *Attorney, Agent, or Firm*—Sughrue Mion, PLLC

(57) ABSTRACT

A variable delivery type fuel supply apparatus capable of suppressing variation of fuel pressure within a delivery pipe and hence variation of fuel quantity injected through fuel injection valves and simplifying a control method therefor. The apparatus includes an oil relief passage (6) provided between the suction port of a fuel pump (4) and a pressurizing chamber (4*e*) across a suction valve (4*a*) of the fuel pump (4), an electromagnetic valve (7) disposed in the oil relief passage (6) and opened for a predetermined time during a discharge stroke of the fuel pump (4) for thereby controlling a discharge quantity of the fuel pump (4), and a control unit (108) for controlling the timing at which the electromagnetic valve (7) is opened. The control unit (108) is so designed as to control open/close operations of the electromagnetic valve (7) such that a time point for starting electrical energization of the electromagnetic valve (7) is fixedly set at a predetermined time point relative to the suction/discharge stroke of the fuel pump (4) while allowing the time point for terminating the electrical energization to be variable, to thereby control the discharge quantity of the fuel pump (4).

2 Claims, 8 Drawing Sheets

VARIABLE DELIVERY TYPE FUEL SUPPLY APPARATUS

BACKGROUND OF THE INVENTION

1. Field of the Invention

The present invention generally relates to a variable delivery type fuel supply apparatus which can be employed, for example, in a cylinder injection type internal combustion engine. More particularly, the present invention is concerned with a variable delivery type fuel supply apparatus which includes an electromagnetic valve disposed in an oil relief passage and adapted to be opened for a predetermined time during a delivery or discharge stroke of a fuel pump for thereby controlling a delivery or discharge quantity of a fuel.

2. Description of Related Art

For better understanding of the concept underlying the present invention, description will first be made of a conventional variable delivery type fuel supply apparatus known heretofore. FIG. 9 of the accompanying drawings shows a circuit diagram of a fuel supply system which includes a variable delivery type fuel supply apparatus 100. Referring to the figure, the variable delivery type fuel supply apparatus 100 is comprised of a low-pressure damper 2 disposed in association with a low-pressure fuel suction passage 1 for absorbing pulsation of a low-pressure fuel flow (i.e., fuel flow of a low pressure), a high-pressure fuel pump 4 for pressurizing a low-pressure fuel fed from the low-pressure damper 2 for discharging pressurized fuel into a high-pressure fuel delivery passage 3, a fuel pressure holding valve 5 for holding a pressure of the fuel flowing through the high-pressure fuel delivery passage 3 under a high pressure, an oil relief passage 6 provided for interconnecting a suction port of the fuel pump 4 and a pressurizing chamber thereof, an electromagnetic valve (which may also be referred to as the solenoid valve) 7 disposed in the oil relief passage 6 and adapted to be opened for a predetermined time during the discharge stroke of the fuel pump 4 for adjusting or regulating the fuel discharge quantity of the fuel pump 4, and a control unit 8 for controlling the valve open timing of the electromagnetic valve 7. The fuel pump 4 includes a suction valve 4*a* and a discharge valve 4*b*.

On the other hand, as the peripheral components of the variable delivery type fuel supply apparatus 100, there are provided a fuel tank 10, a low-pressure fuel pump 11 disposed within the fuel tank 10, a low-pressure regulator 12 disposed in the low-pressure fuel suction passage 1 through which the low-pressure fuel discharged from the low-pressure fuel pump 11 flows, for stabilizing the pressure of the fuel flow, a relief valve 15 disposed in a drain pipe 14 branched from the high-pressure fuel delivery passage 3 at a branching portion 13, and fuel injection valves 18 mounted on a delivery pipe 17 connected to the high-pressure fuel delivery passage 3, and a filter 19 disposed in the drain pipe 14 at an appropriate location thereof.

In operation of the variable delivery type fuel supply apparatus 100 implemented in the structure described above, the suction valve 4*a* of the fuel pump 4 is opened during the suction stroke to suck the fuel in the pressurizing chamber, while in the discharge stroke, the discharge valve 4*b* is opened, whereby the fuel within the pressurizing chamber is discharged into the delivery pipe 17 equipped with the fuel injection valves 18. The oil relief passage 6 is provided across the suction valve 4*a* of the fuel pump 4 for interconnecting the suction port of the high-pressure fuel pump 4 and the pressurizing chamber thereof. The solenoid or electromagnetic valve 7 disposed in the oil relief passage 6 serves for adjusting or regulating the discharge quantity of the fuel pump 4 by opening for a predetermined time in the course of discharge stroke of the fuel pump 4. The control unit 8 is in charge of controlling the valve open timing of the electromagnetic valve 7.

FIG. 10 is a timing chart for illustrating the control or driving signal supplied to the electromagnetic valve 7 from the control unit 8 together with suction/discharge strokes of the fuel pump 4. Referring to FIG. 10, the plunger lift is taken along the ordinate at a top row, in which hatched areas indicate, respectively, the amounts or quantities of the fuel discharged from the fuel pump 4. Further taken along the ordinate at a bottom row is a waveform of an electric current applied for driving the electromagnetic valve 7 which is implemented as a normally closed valve adapted to be opened, i.e., turned on, when it is electrically energized. In the conventional variable delivery type fuel supply apparatus 100, the time point for terminating the electrical energization of the valve 7 (i.e., time point for closing or turning off the valve 7) is fixed at a predetermined timing whereas the energization starting time point (valve open or turn-on time point) is set variable relative to the suction/discharge stroke of the fuel pump 4 for the purpose of controlling the discharge quantity thereof. More specifically, in the case of the example illustrated in FIG. 10, the electrical energization terminating time point (valve close time point) is fixedly set at the end of the discharge stroke (or at the start of the suction stroke, to say in another way), whereas the electrical energization starting time point (valve open time point) is controlled variably during the discharge stroke).

In general, the open/close operation of the electromagnetic or solenoid valve 7 triggered in response to a control signal issued from the control unit 8 is accompanied with a time lag more or less in practical applications. Accordingly, in the conventional variable delivery type fuel supply apparatus, the time lag mentioned above, i.e., delay of response of the electromagnetic valve 7, is arithmetically estimated by the control unit 8 in advance, and the electromagnetic valve 7 is driven or controlled by taking into account the estimated or expected time lag. In this conjunction, it is however noted that such time lag (delay of response) will vary in dependence on changes of the supply voltage, the ambient temperature and other factors, e.g. lowering of the supply voltage, rise of the ambient temperature and/or the like. For this reason, fuel control of the discharge quantity is likely to become nonuniform, giving rise to a problem that variation tends to occur in the fuel pressure within the delivery pipe 17 and hence in the fuel quantity injected through the fuel injection valves 18. In order to cope with this problem, a much complicated control procedure has to be adopted in the conventional variable delivery type fuel supply apparatus.

SUMMARY OF THE INVENTION

In the light of the state of the art described above, it is an object of the present invention to provide a variable delivery type fuel supply apparatus which is capable of reducing or suppressing variation in the fuel pressure within the delivery pipe and hence variation of the fuel quantity injected through the fuel injection valve and which apparatus allows the control method to be simplified.

In view of the above and other objects which will become apparent as the description proceeds, there is provided according to a general aspect of the present invention a variable delivery type fuel supply apparatus which is comprised of a fuel pump including a suction valve adapted to be opened during a suction stroke for sucking a fuel in a pressurizing chamber in the course of reciprocation of a plunger within a cylinder and a discharge valve adapted to be opened during a discharge stroke for discharging the fuel from the pressurizing chamber into a high-pressure fuel delivery passage of an internal combustion engine equipped with fuel injection valves in the course of reciprocation of the plunger within the cylinder, an oil relief passage provided between a suction port of the fuel pump and the pressurizing chamber across the suction valve of the fuel pump so as to interconnect the suction port and the pressurizing chamber, an electromagnetic valve disposed in the oil relief passage and adapted to be opened for a predetermined time during the discharge stroke of the fuel pump for thereby controlling a fuel discharge quantity of the fuel pump, and a control unit for controlling timing at which the electromagnetic valve is opened, wherein the control unit is so designed as to control open/close operations of the electromagnetic valve such that a time point for starting electrical energization of the electromagnetic valve is fixedly set at a predetermined time point relative to the suction/discharge stroke of the fuel pump while allowing a time point for terminating the electrical energization to be variable, to thereby control the fuel discharge quantity of the fuel pump.

By virtue of the arrangement described above, variation of the fuel pressure in the delivery pipe and hence variation of the fuel quantity injected through the fuel injection valve can effectively be suppressed. Further, the response time of the electromagnetic valve is rendered less susceptible to the influence of lowering of the supply voltage, rise of the ambient temperature and the like factors. To say in another way, much stabilized response behavior or performance of the electromagnetic valve can be ensured substantially under any conditions. In addition, because the delay of response remains essentially constant independent of the conditions such as mentioned above, the control method can be much simplified.

In a preferred mode for carrying out the invention, the electromagnetic valve may be implemented as a normally closed valve which is designed to be opened when electrically energized.

With the arrangement described above, the variable delivery type fuel supply apparatus according to the invention can be rendered more insusceptible to the influence of variation of the response time, whereby further enhanced stabilization can be ensured for the response performance of the variable delivery type fuel supply apparatus.

In another mode for carrying out the invention, the electromagnetic valve may preferably be comprised of a valve element which is subjected to a high pressure in a direction perpendicular to an axial direction of a valve closing spring.

Owing to the arrangement mentioned above, the response delay behavior of the electromagnetic valve can be stabilized, whereby the response performance of the variable delivery type fuel supply apparatus can further be stabilized and improved. Besides, the time duration of electrical energization of the electromagnetic valve can be shortened relative to that of the suction/discharge stroke, whereby the coil temperature rise suppressing effect as well as the power consumption reducing effect can significantly be enhanced.

In yet another mode for carrying out the invention, the control unit should preferably be so designed that an electromagnetic valve driving current is increased to a high level immediately after electrical energization of the valve is started while the electromagnetic valve driving current is held at a low level after lapse of a predetermined time since the start of the electrical energization.

Owing to the feature described above, the electric energy supplied to the electromagnetic valve can be reduced, whereby not only the temperature rise of the solenoid or coil can effectively be suppressed but also the power consumption can positively be reduced, to further advantageous effects.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
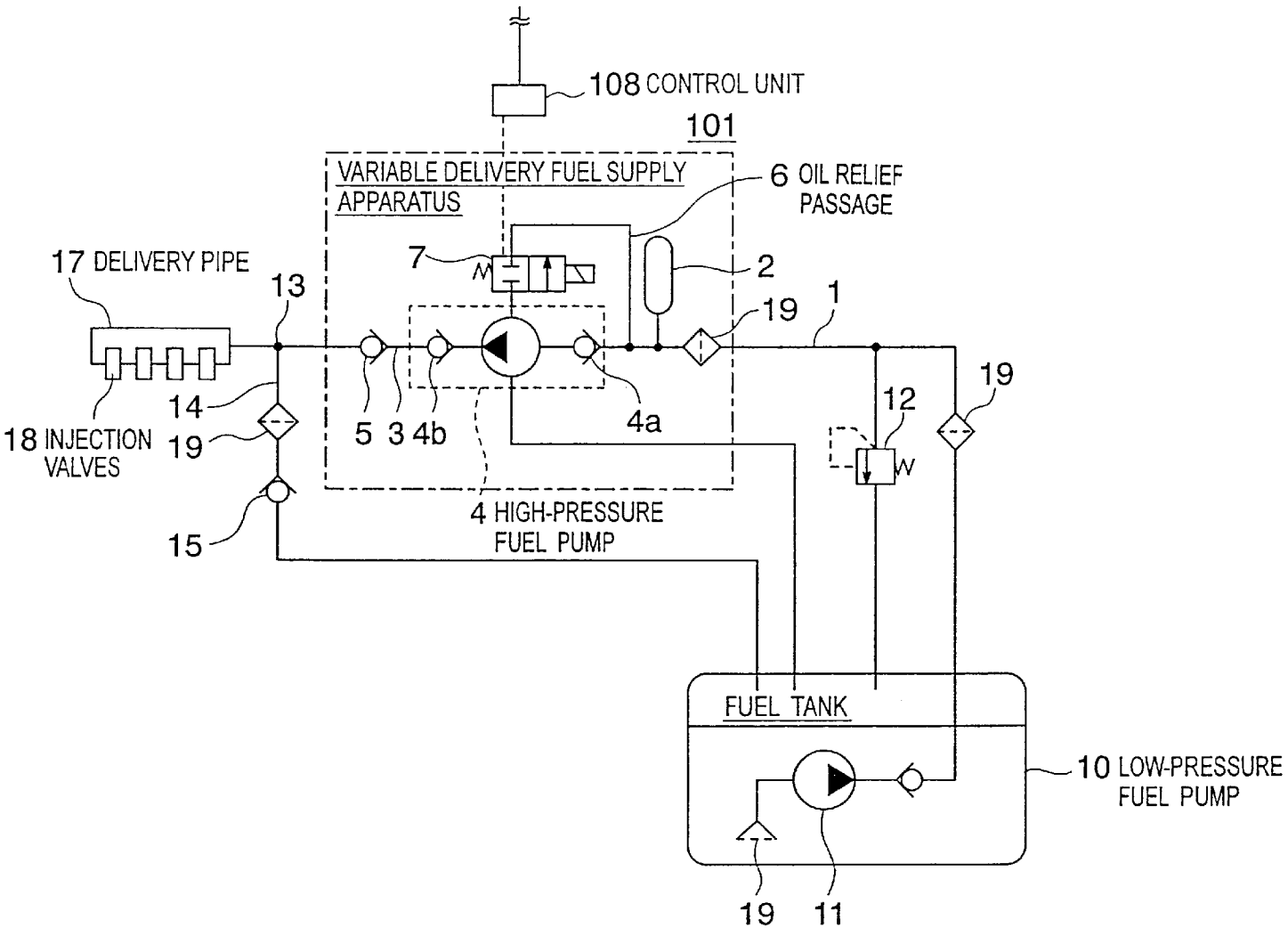
FIG. 1 is a circuit diagram of a fuel supply system equipped with a variable delivery type fuel supply apparatus according to a first embodiment of the present invention.

In the following, the present invention will be described in detail in conjunction with what is presently considered as preferred or typical embodiments thereof by reference to the drawings. In the following description, like reference characters designate like or corresponding parts throughout the several views.

Embodiment 1

FIG. 1 shows a circuit diagram showing an arrangement of a fuel supply system which includes a variable delivery type fuel supply apparatus 101 according to a first embodiment of the present invention. Referring to FIG. 1, the variable delivery type fuel supply apparatus 101 is comprised of a low-pressure damper 2 provided in association with a low-pressure fuel suction passage 1 for absorbing pulsation of a fuel flow, a high-pressure fuel pump 4 for pressurizing the low-pressure fuel fed from the low-pressure damper 2 for thereby discharging the pressurized fuel into a high-pressure fuel delivery passage 3, a fuel pressure holding valve 5 for holding the pressure of the high-pressure fuel flowing through the high-pressure fuel delivery passage 3, an oil relief passage 6 provided for interconnecting a suction port of the fuel pump 4 and a pressurizing chamber across a suction valve 4*a*, an electromagnetic or solenoid valve 7 disposed in the oil relief passage 6 for adjusting or regulating the discharge quantity of the fuel pump 4 by opening for a predetermined time period during the discharge stroke of the fuel pump 4, and a control unit 108 for controlling the open timing of the electromagnetic valve 7. The fuel pump 4 includes a suction valve 4*a* and a discharge valve 4*b*.

On the other hand, as the peripheral components of the variable delivery type fuel supply apparatus 101, there are provided the fuel tank 10 which has a low-pressure fuel pump 11 disposed therein, a low-pressure regulator 12 disposed in the low-pressure fuel suction passage 1 through which the fuel discharged from the low-pressure fuel pump 11 is forced to flow at a low pressure, the regulator 12 serving for stabilizing the pressure level of the low-pressure fuel flow, a relief valve 15 disposed in a drain pipe 14 branched from the high-pressure fuel delivery passage 3 at a branching portion 13, and fuel injection valves 18 mounted in a delivery pipe 17 which is connected to the high-pressure fuel delivery passage 3, and a filter 19 provided at a predetermined location.

In operation of the variable delivery type fuel supply apparatus 101 implemented in the structure described above, the suction valve 4*a* of the fuel pump 4 is opened during the suction stroke to suck the fuel in the pressurizing chamber, while in the discharge stroke, the discharge valve 4*b* is opened, whereby the fuel within the pressurizing chamber is discharged into the delivery pipe 17 equipped with the fuel injection valves 18. The oil relief passage 6 is provided across the suction valve 4*a* of the fuel pump 4 for interconnecting the suction port of the high-pressure fuel pump 4 and the pressurizing chamber thereof. The electromagnetic or solenoid valve 7 disposed in the oil relief passage 6 serves for adjusting or regulating the fuel discharge quantity of the fuel pump 4 by opening for a predetermined time during the discharge stroke of the fuel pump 4. The control unit 108 is in charge of controlling the valve open timing of the electromagnetic valve 7.

Figure 2:
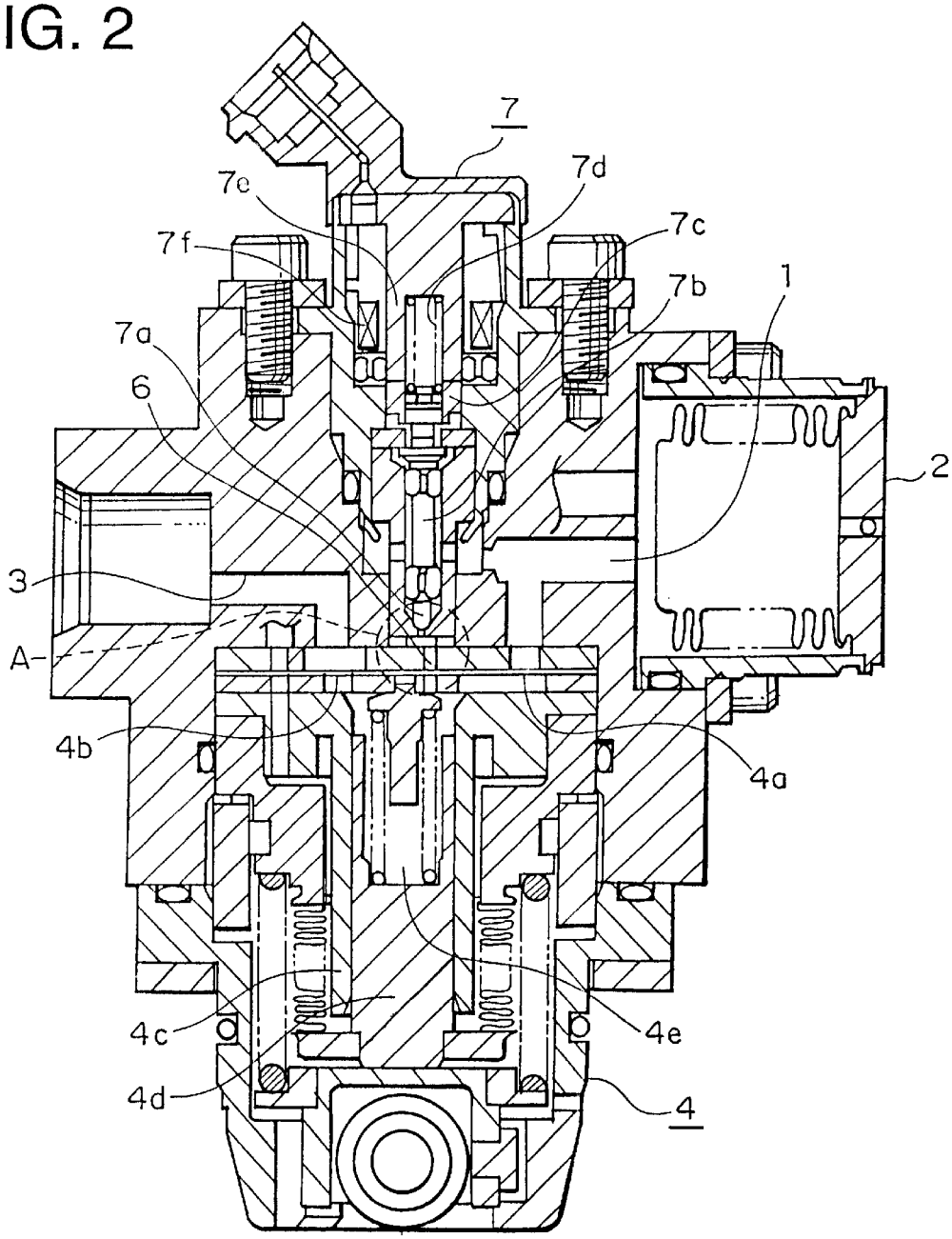
FIG. 2 is a sectional view showing a major portion of the variable delivery type fuel supply apparatus.
Figure 3:
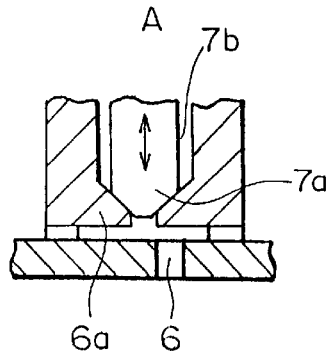
FIG. 3 is an enlarged view of a portion of the fuel supply apparatus indicated as enclosed by a broken line circle A in FIG. 2.

FIG. 2 is a sectional view showing a major portion of the variable delivery type fuel supply apparatus 101, and FIG. 3 is an enlarged view of a portion indicated as enclosed by a broken line circle A in FIG. 2. As can be seen in the figure, the suction valve 4*a* is disposed in the low-pressure fuel suction passage 1 of the fuel pump 4. On the other hand, the discharge valve 4*b* is disposed in the high-pressure fuel delivery passage 3. The fuel taken in or sucked through the suction valve 4*a* is pressurized within the pressurizing chamber 4*e* which is constituted by a cylinder 4*c* and a plunger 4*d*, to be thereby discharged through the discharge valve 4*b*.

The pressurizing chamber 4*e* of the fuel pump 4 is communicated to the low-pressure fuel suction passage 1 by way of the oil relief passage 6 provided across the suction valve 4*a*. The electromagnetic valve 7 is mounted in the oil relief passage 6 at an intermediate portion thereof.

The electromagnetic valve 7 includes a valve 7*b* having a valve element 7*a* mounted at a tip portion thereof for opening/closing the oil relief passage 6. The valve 7*b* is supported movably in the axial direction, whereby the valve element 7*a* mounted at the tip end is selectively moved to or away from a valve sheet 6*a* to thereby close or open the oil relief passage 6. An armature 7*c* formed of a magnetic material is integrally provided at the rear end portion of the valve 7*b*. The valve 7*b* is ordinarily or normally urged resiliently by means of a valve closing spring 7*d* in the direction to close the oil relief passage 6.

The electromagnetic valve 7 further includes a core 7*e* and a solenoid or coil 7*f* wound around the core 7*e*. When the coil 7*f* is electrically energized, magnetic force is generated in the core 7*e* to magnetically attract the armature 7*c*. Then, the valve 7*b* is forced to move against the spring force of the valve closing spring 7*d*, whereby the oil relief passage 6 is opened. On the contrary, upon electrical deenergization of the coil 7*f*, the oil relief passage 6 is closed.

Figure 4:
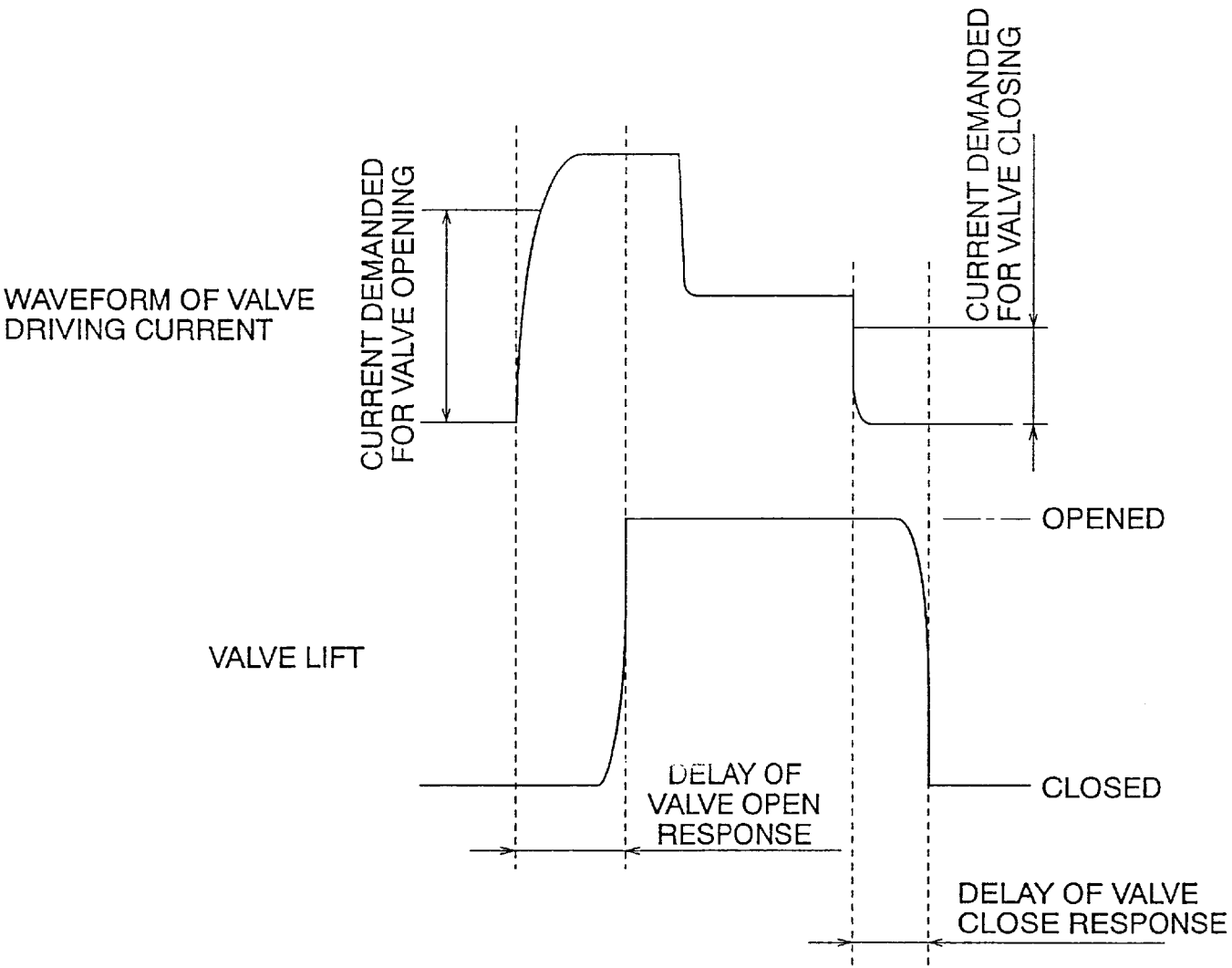
FIG. 4 is a view for graphically illustrating a waveform of an electromagnetic valve driving current and a response delay behavior of the electromagnetic valve.
Figure 5:
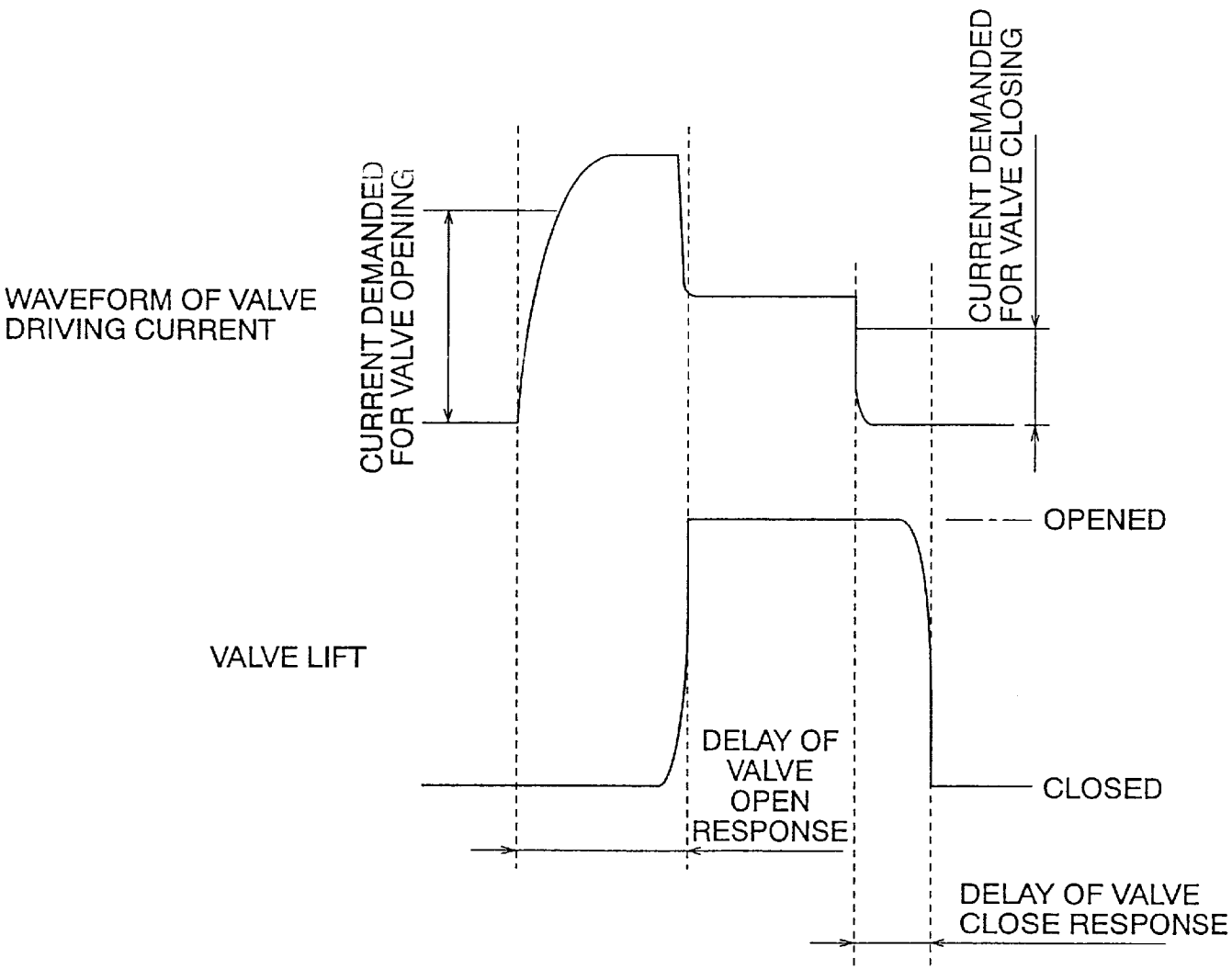
FIG. 5 is a view for graphically illustrating a waveform of the driving current for the electromagnetic valve and a response delay behavior of the electromagnetic valve in the case where a supply voltage to the valve is low as compared with the case illustrated in FIG. 4.

FIG. 4 is a view graphically illustrating a waveform of an electromagnetic valve driving current and valve response delays. Further, FIG. 5 is a view for graphically illustrating a driving current for the electromagnetic valve and electromagnetic valve response delays in the case where the supply voltage is low. In both the figures, the driving current waveform is shown at the top while lift of the electromagnetic valve is schematically shown at the bottom.

In general, in the case of the electromagnetic valve implemented in the structure such as described above, relatively lots of time is taken for the driving current to rise to a current level or value (density of magnetic flux) required for opening the electromagnetic valve when the electromagnetic valve is electrically energized. Similarly, lots of time is also taken for the driving current to fall to a current level (density of magnetic flux) for opening the electromagnetic valve. It is further noted that in the state where the electromagnetic valve is closed, a relatively large distance intervenes between the armature 7*c* and the core 7*e*. In other words, distance between the magnetically attracting surfaces is intrinsically large at the time point when the electrical energization of the electromagnetic valve is started (i.e., when the valve opening is started), as a result of which a relatively large current is required for opening the electromagnetic valve. On the contrary, when the electromagnetic valve is to be closed (i.e., upon electrical deenergization of the valve), the distance between the magnetically interacting surfaces mentioned above is short, which means that the current of a relatively small value is sufficient for closing the electromagnetic valve.

Under the circumstances, with the aim for preventing the delay of response of the electromagnetic valve and reducing the operating current and hence heat generation, such control is adopted that the electromagnetic valve driving current is set at a high level upon starting of the electrical energization and lowered after the electromagnetic valve has been opened. In this conjunction, reference should be made to the driving current waveform shown in FIG. 4. Furthermore, as can be seen in FIG. 4, greater delay of response is involved in the electrical energization which demands a large current as mentioned above when compared with the case of electrical deenergization. Moreover, when the supply voltage becomes low, the delay of response involved in opening the electromagnetic valve increases, as can be seen in FIG. 5. In this case, however, the delay of response involved in the valve closing operation remains substantially unchanged. In this conjunction, it should further be added that the delay of response involved in the valve opening operation increases not only when the supply voltage becomes low, as mentioned above, but also when the ambient temperature rises.

Figure 6:
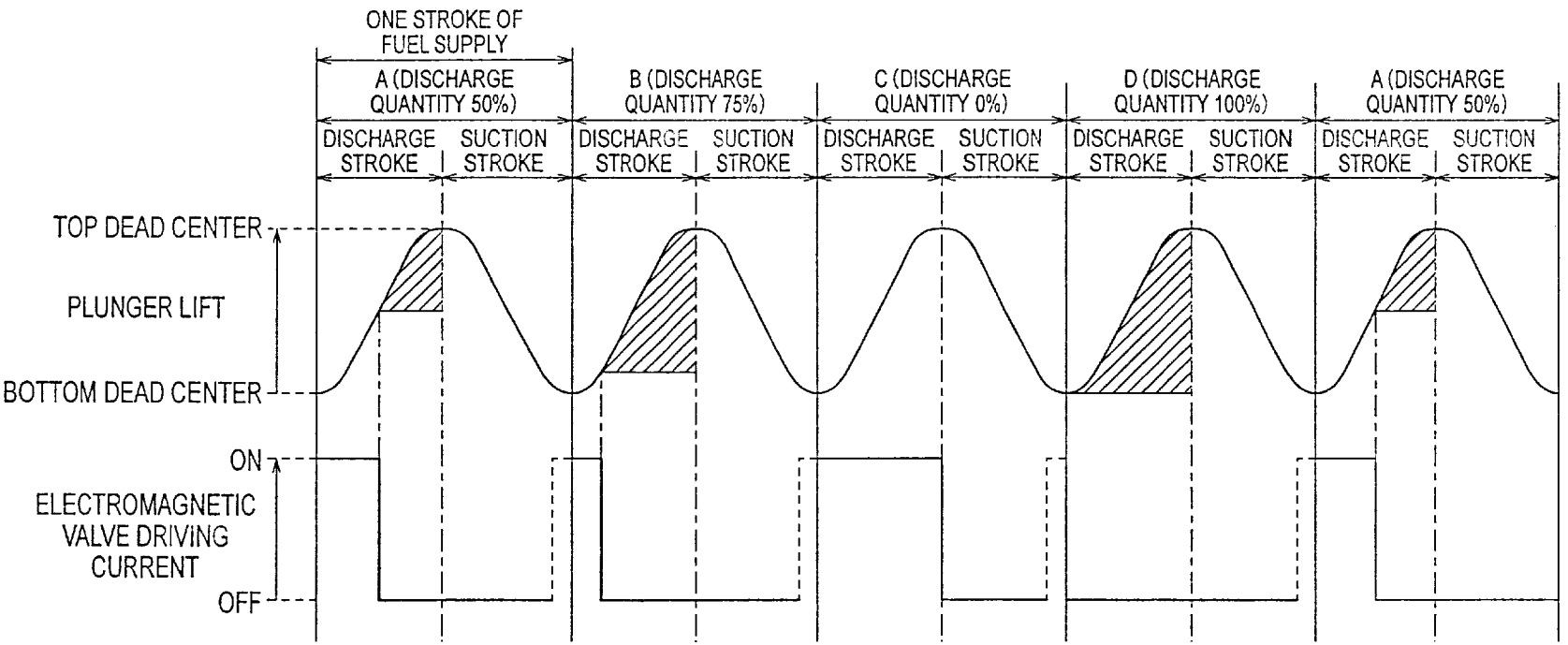
FIG. 6 is a timing chart for illustrating control of a driving signal supplied to the electromagnetic valve from a control unit together with suction/discharge strokes of a high-pressure fuel pump constituting a major part of the fuel supply apparatus.

FIG. 6 is a timing chart for illustrating the driving signal supplied to the electromagnetic valve 7 from the control unit 108 together with suction/discharge strokes of the fuel pump 4. In FIG. 6, plunger lift is taken along the ordinate at a top row, in which hatched areas indicate, respectively, the amounts or quantities of the fuel discharged from the fuel pump 4. Further taken along the ordinate at a bottom row is a waveform of an electric current applied for driving the electromagnetic valve 7 which is implemented as a normally closed valve designed to be opened when it is electrically energized. In the variable delivery type fuel supply apparatus 101 according to the instant embodiment of the invention, the electrical energization starting time point (valve open time point) is fixed at a predetermined timing whereas the electrical energization terminating time point (valve close time point) is set variable relative to the suction/discharge stroke of the fuel pump 4, for thereby controlling the fuel discharge quantity of the fuel pump 4. More specifically, in the case of the example illustrated in FIG. 6, the electrical energization starting time point (valve open time point) is fixedly set around the end of the suction stroke, whereas the electrical energization terminating time point (valve close time point) is controlled variably during the discharge stroke.

In the variable delivery type fuel supply apparatus 101 implemented in the structure described above, the time point for starting the electrical energization of the electromagnetic valve 7 is fixedly set at or around the end of the suction stroke while the time point for terminating the electrical energization is controlled variably during the discharge stroke. By virtue of this feature, the response time of the electromagnetic valve can be made less susceptible to the influence of lowering of the supply voltage, rise of the ambient temperature and the like. To say in another way, much stabilized response behavior of performance of the electromagnetic valve can be ensured substantially under any conditions.

As mentioned previously, the delay of response of the electromagnetic valve upon termination of the electric energization is small as compared with the delay of response involved when the electrical energization is started even under the ordinary favorable conditions. Accordingly, stabilized control can be realized in response to the driving signal of the control unit 108. In addition, because the delay of response remains essentially constant independent of the conditions such as mentioned above, the control method can be much simplified.

Of course, the delay of response will change in dependence on the specifications of the electromagnetic valve and the waveform of the driving current. In this conjunction, experiment was performed on a variable delivery type fuel supply apparatus fabricated according to the teachings of the present invention. It has been found that the delay of response upon starting of the electrical energization lies within a range of 1.0 ms to 1.8 ms when the supply voltage is lowered or when the ambient temperature rises. On the other hand, the response rate to the electrical deenergization remains substantially constant on the order of 0.5 ms to 0.6 ms.

As can now be appreciated from the foregoing, the variable delivery type fuel supply apparatus 101 according to the first embodiment of the present invention is comprised of the high-pressure fuel pump 4 including the suction valve 4*a* which is opened in the suction stroke for sucking the fuel in the pressurizing chamber 4*e* in the course of reciprocation of the plunger 4*d* within the cylinder 4*c* and the discharge valve 4*b* which is opened in the discharge stroke for discharging the fuel from the pressurizing chamber 4*e* into the high-pressure fuel delivery passage 3 of an engine equipped with electromagnetic valves (e.g. fuel injection valves), the oil relief passage 6 provided between the suction port of the fuel pump 4 and the pressurizing chamber 4*e* across the suction valve 4*a* of the fuel pump 4, the electromagnetic valve 7 disposed in the oil relief passage 6 and opened for a predetermined time period during the discharge stroke of the fuel pump 4 for thereby controlling the fuel discharge quantity of the fuel pump 4, and the control unit 108 for controlling the timing at which the electromagnetic valve 7 is opened, wherein the control unit 108 is so programmed or designed as to control the open/close operations of the electromagnetic valve 7 such that the time point for starting the electrical energization is fixedly set at a predetermined time point relative to the suction/discharge stroke of the fuel pump 4 while allowing the time point for termination of the electrical energization to be variable, for thereby control the quantity of fuel discharge from the fuel pump 4. By virtue of this feature, variation of the fuel pressure in the delivery pipe 17 and the fuel quantity injected by the fuel injection valve 18 can effectively be suppressed. Further, the response time of the electromagnetic valve is less susceptible to the influence of lowering of the supply voltage, rise of the ambient temperature and the like factors. To say in another way, much stabilized response behavior or performance of the electromagnetic valve can be ensured substantially under any conditions. In addition, because the delay of response remains essentially constant independent of the conditions such as mentioned above, the control method can be much simplified.

The electromagnetic valve 7 is implemented as the normally closed valve which is opened in response to the electrical energization. Thus, the variable delivery type fuel supply apparatus according to the invention can be rendered more insusceptible to the influence of variation of the response time, whereby there can be realized further enhanced stabilization of the response performance of the variable delivery type fuel supply apparatus.

Moreover, the control unit 108 is so designed that the electromagnetic valve driving current is increased to a high level immediately after the electrical energization is started while the electromagnetic valve driving current is held at a low level after lapse of a predetermined time since the start of the electrical energization. Owing to this feature, the electric energy supplied to the electromagnetic valve 7 can be reduced, whereby the temperature rise of the solenoid or coil can effectively be suppressed with the power consumption being positively reduced, to further advantageous effects.

Embodiment 2

Figure 7:
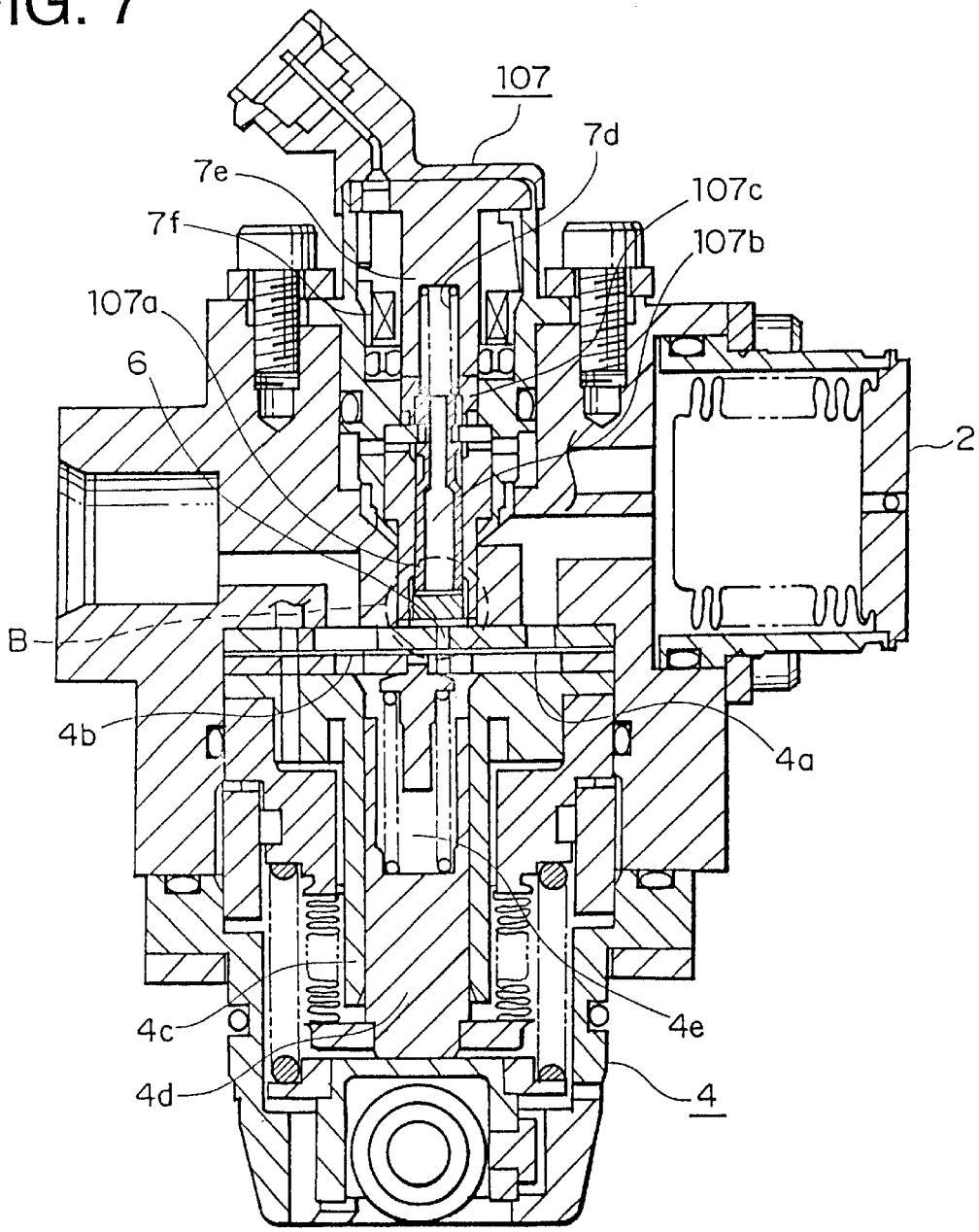
FIG. 7 is a sectional view showing a major portion of a variable delivery type fuel supply apparatus according to a second embodiment of the present invention.
Figure 8:
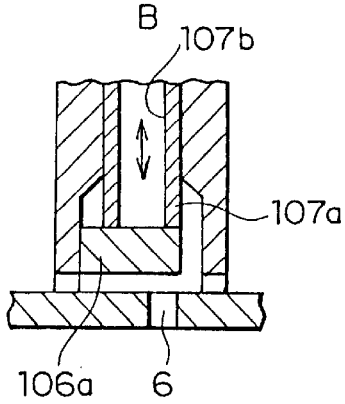
FIG. 8 is an enlarged view of a portion of the fuel supply apparatus indicated as enclosed by a broken line circle B in FIG. 7.
Figure 9:
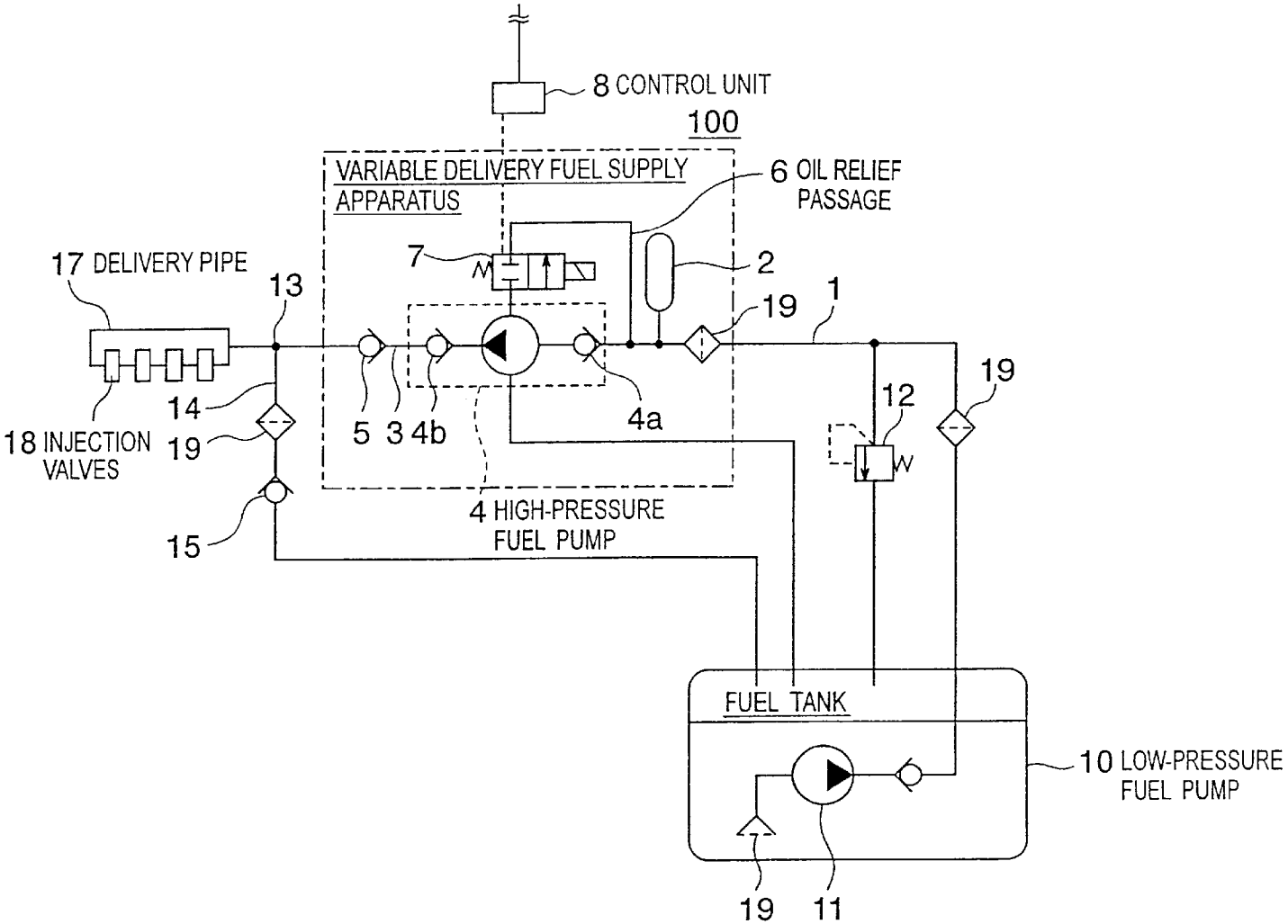
FIG. 9 PRIOR ART
FIG. 9 is a circuit diagram of a fuel supply system which includes a conventional variable delivery type fuel supply apparatus.
Figure 10:
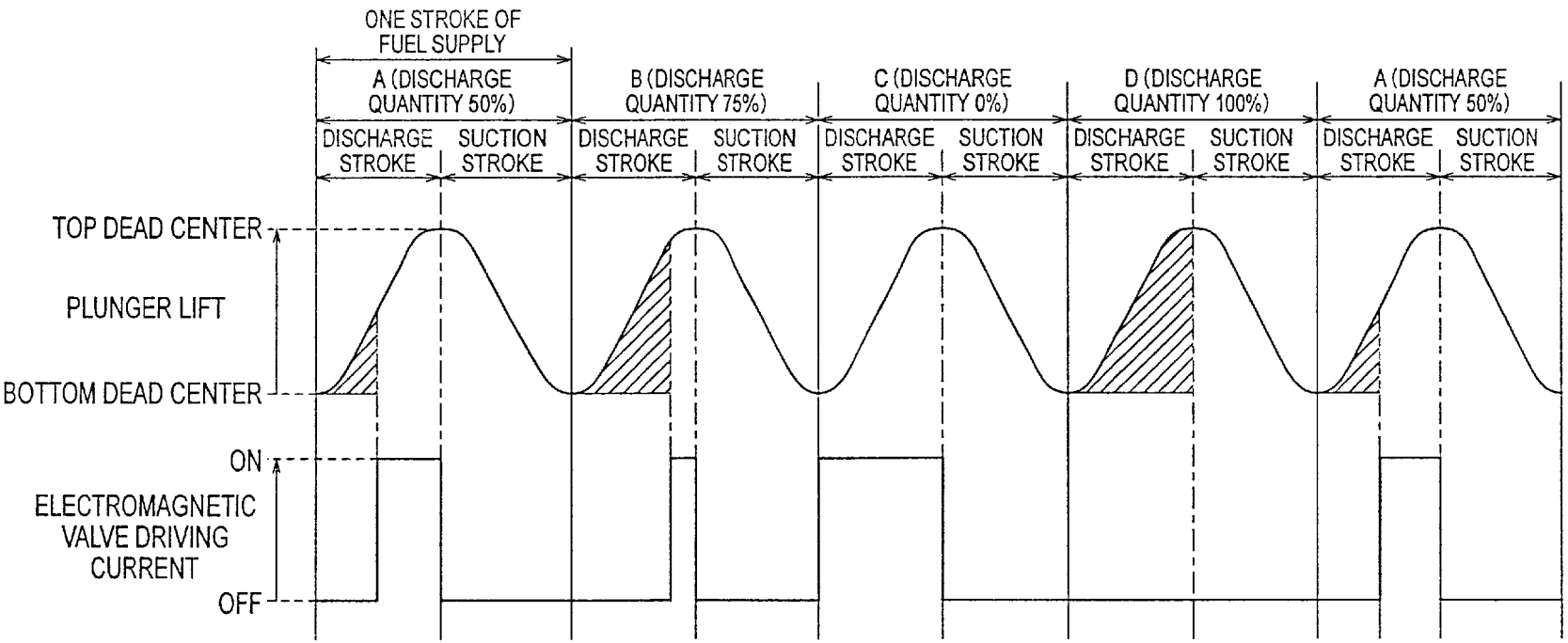
FIG. 10 PRIOR ART
FIG. 10 is a timing chart for illustrating a control or driving signal supplied to an electromagnetic valve of the fuel supply apparatus from a control unit together with suction/discharge strokes of the fuel supply apparatus.

FIG. 7 is a sectional view showing a major portion of the variable delivery type fuel supply apparatus according to a second embodiment of the present invention, and FIG. 8 is an enlarged view of a portion indicated as enclosed by a broken line circle B in FIG. 7. In the variable delivery type fuel supply apparatus according to the instant embodiment of the invention, a valve 107*b* and an armature 107*c* provided integrally with the valve 107*b* are each formed approximately in a cylindrical shape. Besides, a valve element 107*a* is also formed substantially cylindri-cally. The cylindrical valve element 107*a* is adapted to move to and away from a planar valve sheet 106*a* for closing/ opening the oil relief passage 6. With regards to the other respects, the variable delivery type fuel supply apparatus according to the instant embodiment of the invention is essentially same as that of the first embodiment.

In the case of the variable delivery type fuel supply apparatus according to the first embodiment of the invention, the valve element is subjected to a pressure in the axial direction of the valve closing spring 7*d*. On the other hand, in the case of the variable delivery type fuel supply apparatus according to the instant embodiment of the invention, the valve element 107*a* is subjected to the pressure in the direction perpendicular to the axial direction of the valve closing spring 7*d*. By virtue of such arrangement, the response delay behavior of the electromagnetic or solenoid valve 7 can further be stabilized. Besides, in the variable delivery type fuel supply apparatus according to the instant embodiment, the electromagnetic valve 7 can respond at a higher speed when compared with that of the variable delivery type fuel supply apparatus according to the first embodiment. Thus, the time duration of electrical energization of the electromagnetic valve during the suction/discharge stroke can be shortened, whereby the coil temperature rise suppressing effect as well as power consumption reducing effect can significantly be enhanced.

As described above, in the variable delivery type fuel supply apparatus according to the second embodiment of the invention, the electromagnetic valve 7 includes the valve 107*b* which is subjected to a high pressure in the direction perpendicular to the axial direction of the valve closing spring 7*d*. Owing to this arrangement, the response delay behavior of the electromagnetic valve 7 can be stabilized, whereby stability of the response performance of the variable delivery type fuel supply apparatus can further be enhanced. Besides, the time duration of electrical energization of the electro-magnetic valve 7 can be shortened relative to that of the suction/discharge stroke, whereby the coil temperature rise suppressing effect as well as power consumption reducing effect can significantly be enhanced.

Many modifications and variations of the present invention are possible in the light of the above techniques. It is therefore to be understood that within the scope of the appended claims, the invention may be practiced otherwise than as specifically described.

What is claimed is:

1. A variable delivery type fuel supply apparatus, comprising:

a fuel pump including a suction valve which is opened during a suction stroke for sucking a fuel in a pressurizing chamber in the course of reciprocation of a plunger within a cylinder and a discharge valve which is opened during a discharge stroke for discharging the fuel from said pressurizing chamber into a high-pressure fuel delivery passage of an internal combustion engine equipped with fuel injection valves in the course of reciprocation of said plunger within said cylinder;

an oil relief passage provided between a suction port of said fuel pump and said pressurizing chamber across said suction valve of said fuel pump so as to interconnect said suction port and said pressurizing chamber;

a normally closed electromagnetic valve, which is designed to be opened by an electrical energization, disposed in said oil relief passage and opened for a predetermined time during the discharge stroke of said fuel pump for thereby controlling a fuel discharge quantity of said fuel pump, wherein said electromagnetic valve includes a valve element which is subjected to a high pressure in a direction perpendicular to an axial direction of a valve closing spring; and a control unit for controlling timing at which said electromagnetic valve is opened, wherein said control unit is so designed as to control open/close operations of said electromagnetic valve such that a time point for opening said electromagnetic valve by starting said electrical energization of said electromagnetic valve is fixedly set at a predetermined time point relative to the suction/discharge stroke of said fuel pump while allowing a time point for terminating said electrical energization and closing said electromagnetic valve to be variable, to thereby control the fuel discharge quantity of said fuel pump.

2. A variable delivery type fuel supply apparatus according to claim 1, wherein said control unit is so designed that an electromagnetic valve driving current is increased to a high level immediately after electrical energization of said valve is started while said electromagnetic valve driving current is held at a low level after lapse of a predetermined time since the start of said electrical energization.

* * * * *